US010221044B2

(12) United States Patent
Fonteneau et al.

(10) Patent No.: US 10,221,044 B2
(45) Date of Patent: Mar. 5, 2019

(54) HOISTWAY DOOR LOCKING SYSTEM AND METHOD OF CONTROLLING ACCESS TO AN ELEVATOR SHAFT

(71) Applicant: OTIS ELEVATOR COMPANY, Farmington, CT (US)

(72) Inventors: Nicolas Fonteneau, Chateauneuf sur Loire (FR); Aurélien Fauconnet, Isdes (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/500,402

(22) PCT Filed: Aug. 22, 2014

(86) PCT No.: PCT/IB2014/001844

§ 371 (c)(1),
(2) Date: Jan. 30, 2017

(87) PCT Pub. No.: WO2016/027118

PCT Pub. Date: Feb. 25, 2016

(65) Prior Publication Data

US 2017/0210600 A1 Jul. 27, 2017

(51) Int. Cl.
*B66B 13/18* (2006.01)
*B66B 13/22* (2006.01)
(Continued)

(52) U.S. Cl.
CPC ..... *B66B 13/18* (2013.01); *B66B 13/185* (2013.01); *B66B 13/22* (2013.01); *B66B 13/14* (2013.01); *B66B 13/16* (2013.01); *B66B 13/165* (2013.01)

(58) Field of Classification Search
CPC ..... B66B 13/18; B66B 13/22; B66B 13/14; B66B 13/16; B66B 13/165; B66B 1/24
(Continued)

(56) References Cited

U.S. PATENT DOCUMENTS 255,448 A 10/1882 Sawyer
265,448 A * 10/1882 Sawyer ..... B66B 13/22 187/280
(Continued)

FOREIGN PATENT DOCUMENTS

CN 204281007 U 4/2015
CN 104803265 A 7/2015
(Continued)

OTHER PUBLICATIONS

Search Report and Written Opinion regarding related PCT App. No. PCT/IB2014/001844; dated May 7, 2015; 9 pgs.
(Continued)

*Primary Examiner* — David Warren
(74) *Attorney, Agent, or Firm* — Cantor Colburn LLP

(57) ABSTRACT

A hoistway door locking system includes an elevator shaft. Also included is an elevator car disposed within the elevator shaft and moveable therein between a plurality of access openings located at a plurality of levels of the elevator shaft. Further included is a plurality of locking mechanisms, at least one of the plurality of locking mechanisms being located at each of the plurality of access openings, wherein each of the plurality of locking mechanisms is operable between a locked condition and an unlocked condition, and wherein only a single locking mechanism may be in the unlocked condition at a specific time, the unlocked condition occurring upon alignment of the elevator car and the respective access opening having the single locking mechanism.

6 Claims, 1 Drawing Sheet

(51) Int. Cl.
*B66B 13/14* (2006.01)
*B66B 13/16* (2006.01)

(58) Field of Classification Search
USPC ..... 187/280
See application file for complete search history.

(56) References Cited

U.S. PATENT DOCUMENTS

| | | | | |
|---|---|---|---|---|
| 3,991,858 | A * | 11/1976 | Westerlund | B66B 13/20 187/308 |
| 4,009,767 | A * | 3/1977 | Stadigh | B66B 13/185 187/280 |
| 4,436,184 | A * | 3/1984 | Dorman | B66B 13/08 187/331 |
| 7,145,433 | B2 | 12/2006 | Gerstenkorn | |
| 8,365,870 | B2 | 2/2013 | Sirigu et al. | |
| 9,695,015 | B1 * | 7/2017 | Marinelli | B66B 13/16 |
| 2001/0035828 | A1 * | 11/2001 | Rossignol | B66B 1/3492 340/686.1 |
| 2005/0034931 | A1 * | 2/2005 | Deplazes | B66B 13/125 187/313 |
| 2011/0272216 | A1 * | 11/2011 | Kugiya | B66B 5/0031 187/301 |
| 2012/0006629 | A1 * | 1/2012 | Heath | B66B 13/185 187/335 |
| 2013/0001023 | A1 | 1/2013 | Leutenegger et al. | |
| 2013/0228399 | A1 * | 9/2013 | Eto | B66B 1/2458 187/382 |
| 2013/0292212 | A1 * | 11/2013 | Fierri | B66B 13/20 187/331 |
| 2014/0076670 | A1 | 3/2014 | Henseler | |
| 2016/0130116 | A1 * | 5/2016 | Kitazawa | B66B 13/12 187/335 |
| 2016/0236907 | A1 * | 8/2016 | Zhang | B66B 13/12 |
| 2017/0210600 | A1 * | 7/2017 | Fonteneau | B66B 13/18 |
| 2017/0217732 | A1 * | 8/2017 | Kitazawa | B66B 13/20 |
| 2017/0355569 | A1 * | 12/2017 | Wang | B66B 5/0031 |
| 2018/0037436 | A1 * | 2/2018 | Aitamurto | B66B 1/2416 |
| 2018/0072538 | A1 * | 3/2018 | Fauconnet | B66B 11/0253 |

FOREIGN PATENT DOCUMENTS

| | | | |
|---|---|---|---|
| EP | 1882666 | A1 | 1/2008 |
| GB | 1498039 | A | 1/1978 |
| JP | H05338973 | A | 12/1993 |
| JP | H061576 | A | 1/1994 |
| JP | H061577 | A | 1/1994 |
| JP | H06247676 | A | 9/1994 |
| JP | 2003201071 | A | 7/2003 |
| SU | 3685 | A1 | 9/1927 |

OTHER PUBLICATIONS

English translation of Office Action regarding related RU Application No. 2017107260/11; dated May 29, 2018; 6 pgs.
English translation of First Office Action regarding related CN App. No. 201480081403.1; dated Jun. 28, 2018; 7 pgs.
English translation of Office Action regarding related JP App. No. JP2017-529162; dated Jul. 24, 2018; 3 pgs.

* cited by examiner

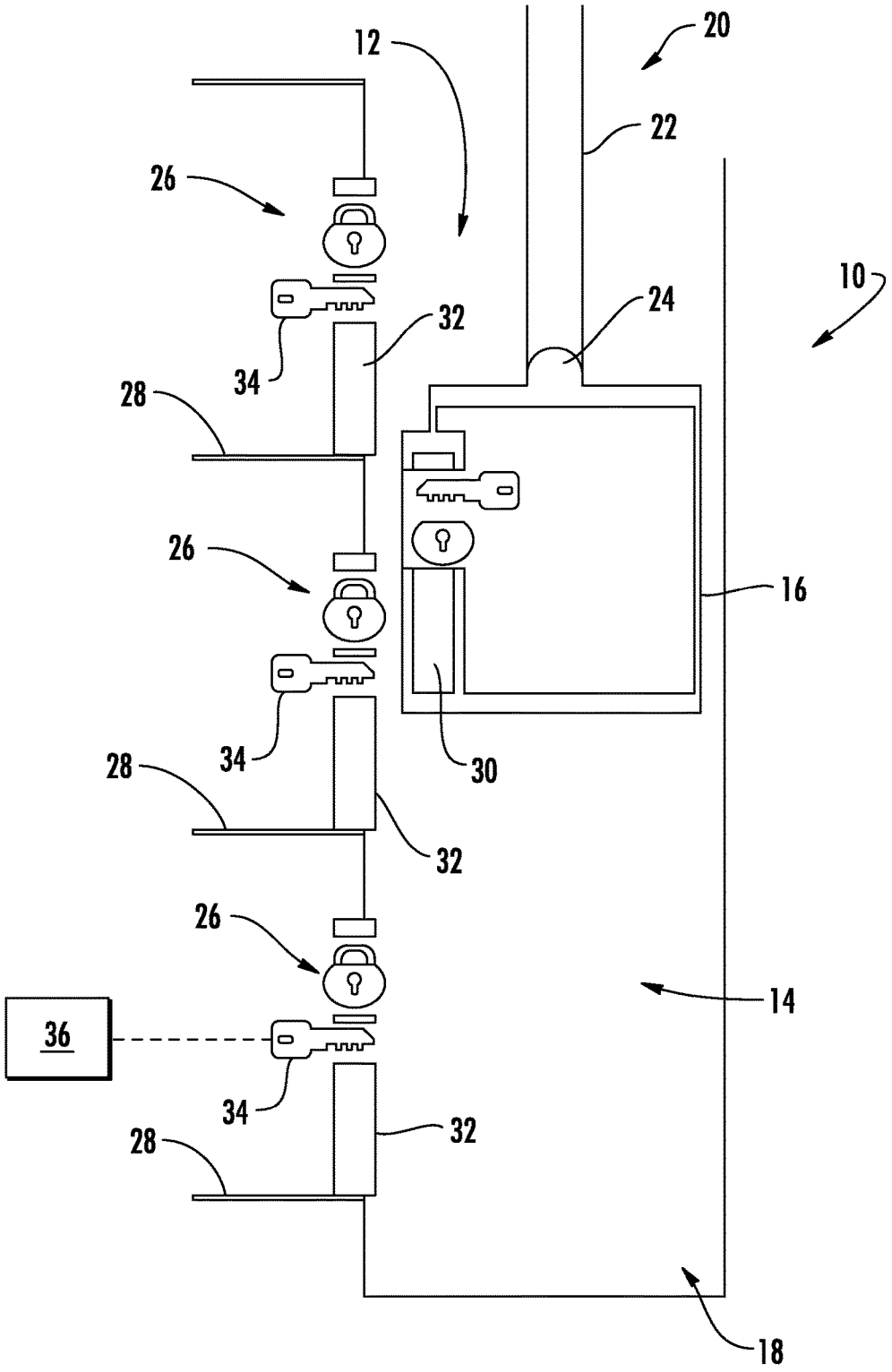
12
20
22
26
10
24
32
34
28
26
16
34
30
28
32
26
14
36
34
32
28
18

HOISTWAY DOOR LOCKING SYSTEM AND METHOD OF CONTROLLING ACCESS TO AN ELEVATOR SHAFT

CROSS-REFERENCE TO RELATED APPLICATION

This patent application claims the benefit of priority to International Patent Application Serial No. PCT/IB2014/001844, filed Aug. 22, 2014, which is incorporated herein by reference in its entirety.

BACKGROUND OF THE INVENTION

The embodiments herein generally relate to elevator systems and, more particularly, to a hoistway door locking system for use with elevator systems, as well as a method of controlling access to an elevator shaft.

Elevators with a shallow pit and/or a low overhead are advantageous because of the reduced impact of their installation on the construction cost and because of the compatibility with severe architectural constraints. However, mechanics are currently tasked with going to the top of the car, or into the pit for inspection or maintenance activities. Unwanted access into the elevator shaft may also occur through access openings of the elevator shaft by vandals or other unauthorized individuals. Either way, the possibility of individuals being within the elevator shaft and outside of the elevator car poses safety risks to those individuals. As such, certain regulatory measures, particularly in Europe, have been proposed and/or enacted that will require larger spaces at the top of the elevator shaft and within the pit to prevent the likelihood of an individual being injured. This required additional space is undesirable from a construction and architectural standpoint, as described above.

One approach to combat the above-noted conflicting interests is to avoid the need for mechanics or otherwise authorized personnel to be in the elevator shaft outside of the elevator car. For example, all inspection and maintenance activity may be conducted from within the elevator car. Unfortunately, as described above, unauthorized individuals may continue to access the elevator shaft through access openings, thereby leaving open the possibility of unwanted access to the elevator shaft.

BRIEF DESCRIPTION OF THE INVENTION

According to one embodiment, a hoistway door locking system includes an elevator shaft. Also included is an elevator car disposed within the elevator shaft and moveable therein between a plurality of access openings located at a plurality of levels of the elevator shaft. Further included is a plurality of locking mechanisms, at least one of the plurality of locking mechanisms being located at each of the plurality of access openings, wherein each of the plurality of locking mechanisms is operable between a locked condition and an unlocked condition, and wherein only a single locking mechanism may be in the unlocked condition at a specific time, the unlocked condition occurring upon alignment of the elevator car and the respective access opening having the single locking mechanism.

In addition to one or more of the features described above, or as an alternative, further embodiments may include that all of the plurality of locking mechanisms other than the single locking mechanism that is disposed at the respective access opening that is aligned with the elevator car are in the locked condition.

In addition to one or more of the features described above, or as an alternative, further embodiments may include that the elevator car includes an unlocking element, wherein the plurality of locking mechanisms are configured to switch from the locked condition to the unlocked condition upon detection of the unlocking element within a predetermined proximity.

In addition to one or more of the features described above, or as an alternative, further embodiments may include a landing door disposed at each of the plurality of access openings of the elevator shaft. Also included is an elevator car door of the elevator car, wherein the predetermined proximity corresponds to alignment of the landing door and the elevator car door.

In addition to one or more of the features described above, or as an alternative, further embodiments may include that mechanical engagement between the unlocking element and the plurality of locking mechanisms actuates switching from the locked condition to the unlocked condition.

In addition to one or more of the features described above, or as an alternative, further embodiments may include that the plurality of locking mechanisms comprise proximity sensors configured to detect the unlocking element.

In addition to one or more of the features described above, or as an alternative, further embodiments may include that the plurality of locking mechanisms and the unlocking element comprise magnetic components magnetically attracted to each other to switch from the locked condition to the unlocked condition.

In addition to one or more of the features described above, or as an alternative, further embodiments may include that the plurality of locking mechanisms are in operative communication with a controller.

According to another embodiment, a method of controlling access to an elevator shaft is provided. The method includes moving an elevator car within an elevator shaft between a plurality of access openings of the elevator shaft, each of the plurality of access openings having a landing door moveable between an open and closed position. The method also includes maintaining landing doors in a locked condition with a plurality of locking mechanisms. The method further includes determining if the elevator car is within a predetermined proximity of each of the access openings with the plurality of locking mechanism. The method yet further includes unlocking the landing door if the elevator car is determined to be within the predetermined proximity of the access opening.

In addition to one or more of the features described above, or as an alternative, further embodiments of the method may include that unlocking the landing door comprises maintaining all of the other landing doors in the locked condition.

In addition to one or more of the features described above, or as an alternative, further embodiments of the method may include that determining if the elevator car is within a predetermined proximity of the access openings comprises detecting an unlocking element disposed on the elevator car with the plurality of locking mechanisms, wherein the predetermined proximity comprises alignment of an elevator car door and the landing door.

In addition to one or more of the features described above, or as an alternative, further embodiments of the method may include that detecting the unlocking element includes employing a proximity sensor.

In addition to one or more of the features described above, or as an alternative, further embodiments of the method may include that detecting the unlocking element includes mechanically engaging the unlocking element.

In addition to one or more of the features described above, or as an alternative, further embodiments of the method may include that detecting the unlocking element includes magnetic attraction between the locking mechanism and the unlocking element.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

FIG. 1 is a schematic illustration of an elevator assembly.

DETAILED DESCRIPTION OF THE INVENTION

Referring to FIG. 1 an elevator assembly is illustrated and generally referenced with numeral 10. The embodiments described herein relate to a door locking system 12 and a method that facilitates control of access to an elevator shaft 14 of the elevator assembly 10, as will be described in detail below. The elevator assembly 10 includes an elevator car 16 that moves along guide rails in a known manner. The elevator car 16 is disposed within the elevator shaft 14 and is moveable therein, typically in a vertical manner. In one embodiment, the elevator car 16 essentially moves along the entire length of the elevator shaft 14 between a lower end 18 (i.e., a pit) and an upper end 20. A drive system (not illustrated) includes a motor and brake and is conventionally used to control the vertical movements of the elevator car 16 along the elevator shaft 14 via a traction system (partially illustrated) that includes cables or the like 22 and at least one pulley 24.

As described above, the elevator car 16 moves within the elevator shaft 14 between the lower end 18 and the upper end 20. More specifically, the elevator car 16 is configured to stop therebetween at a plurality of access openings 26 located at a plurality of levels 28 of the elevator shaft 14. The elevator car 16 includes an elevator door 30 and each of the access openings 26 includes a landing door 32. Upon alignment of the elevator door 30 and one of the landing doors 32, both doors may be opened to allow entrance or exit to the elevator car 16 for people and/or cargo.

In order to prevent access to the elevator shaft in situations other than the above-described scenario (i.e., alignment of elevator door 30 and landing door 32), the door locking system 12 is provided to limit access to loading and unloading of the elevator car 16. The door locking system 12 includes a plurality of locking mechanisms 34, with at least one of the plurality of locking mechanism 34 located at each of the plurality of access openings to thereby control functionality of the landing doors 32. More specifically, each locking mechanism at each level 28 of the elevator shaft 14 is operable between a locked condition and an unlocked condition. The locked condition corresponds to a locked state of the respective landing door 32 that the particular locking mechanism 34 is associated with. Similarly, the unlocked condition corresponds to an unlocked state of the respective landing door 32 that the particular locking mechanism 34 is associated with. The operative connection or communication between the locking mechanisms 34 and the landing doors 32 may be wired or wireless and facilitates a mechanical locking and unlocking of the landing doors 32.

The door locking system 12 limits access to the elevator shaft 14 to situations where the elevator door 30 and one of the landing doors 32 are in alignment. To achieve this technical effect, only a single locking mechanism 34 may be in the unlocked condition at any given specific time. As described above, the unlocked condition occurs only upon alignment of the elevator door 30 and one of the landing doors 32. Such a requirement results in all other locking mechanisms 34 being in the locked condition. Therefore, it is only possible for one locking mechanism 34 to be in the unlocked condition at a time. Based on this only occurring when the elevator door 30 is aligned with the respective landing door 32, it is not possible for an individual to obtain access to the elevator shaft 14 for any reason other than entering the elevator car 16.

The plurality of locking mechanisms 34 may be any device configured to detect alignment of the elevator door 30 with the respective landing door 32 that each of the locking mechanisms 34 are associated with. In one embodiment, the elevator car 16 includes an unlocking element that is configured to be detected when aligned in a certain manner with each of the locking mechanism 34 or when the unlocking element is disposed within a certain predetermined proximity of the locking mechanisms 34. The relationship between the plurality of locking mechanisms 34 and the unlocking element of the elevator car 16 may be mechanical, electrical or electromechanical. Furthermore, switching between the locked and unlocked condition in response to detection of the unlocking element of the elevator car 16 may or may not require direct engagement. For example, direct mechanical engagement is required in one embodiment. However, in other embodiments, a sensor that does not require engagement may be employed. An example of such an embodiment includes a proximity sensor that is configured to detect the unlocking element and switch between the locked and unlocked condition. In other embodiments, a magnetic or electromagnetic relationship may be present, such that the unlocking element comprises magnetic components that are magnetically attracted to the locking mechanisms 34.

In any of the above-described embodiments, a controller 36 may be included in the door locking system 12. The controller 36 is in operative communication with the plurality of locking mechanisms 34 and/or the landing doors 32. The communication between the controller 36 and the locking mechanisms 34 and/or the landing doors 32 may be wired or wireless. In one embodiment, the locking mechanisms 34 directly command the locked or unlocked condition of the landing doors 32. In other embodiments, the locking mechanisms 34 indirectly command the landing doors 32 via the controller 36.

As can be appreciated from the description of the embodiments herein, manipulation of the components of the door locking system 12 may be achieved mechanically, electrically, electromechanically, and/or optically, for example.

Advantageously, opening of the landing doors 32 is enabled only if the elevator car 16 is located directly in front of one of the access openings 26. The door locking system 12 prevents individuals from being on top of the elevator car 16 or in the pit of the elevator shaft 14, thereby overcoming safety issues associated with such a possibility. This system and method allows regions of the elevator shaft 14 to be reduced in volume, which is desirable for architectural and construction purposes.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A hoistway door locking system comprising:

an elevator shaft;

an elevator car disposed within the elevator shaft and moveable therein between a plurality of access openings located at a plurality of levels of the elevator shaft;

a plurality of locking mechanisms, at least one of the plurality of locking mechanisms being located at each of the plurality of access openings, wherein each of the plurality of locking mechanisms is operable between a locked condition and an unlocked condition, and wherein only a single locking mechanism may be in the unlocked condition at a specific time, the unlocked condition occurring upon alignment of the elevator car and the respective access opening having the single locking mechanism; and an unlocking element coupled to the elevator car, the plurality of locking mechanisms configured to switch from the locked condition to the unlocked condition upon detection of the unlocking element within a predetermined proximity, each of the plurality of locking mechanisms being a proximity sensor that does not require direct engagement with the unlocking element to switch between the locked condition and the unlocked condition.

2. The hoistway door locking system of claim 1, wherein all of the plurality of locking mechanisms other than the single locking mechanism that is disposed at the respective access opening that is aligned with the elevator car are in the locked condition.

3. The hoistway door locking system of claim 1, further comprising:

a landing door disposed at each of the plurality of access openings of the elevator shaft; and an elevator car door of the elevator car, wherein the predetermined proximity corresponds to alignment of the landing door and the elevator car door.

4. The hoistway door locking system of claim 1, wherein the plurality of locking mechanisms are in operative communication with a controller.

5. A method of controlling access to an elevator shaft comprising:

moving an elevator car within an elevator shaft between a plurality of access openings of the elevator shaft, each of the plurality of access openings having a landing door moveable between an open and closed position;

maintaining landing doors in a locked condition with a plurality of locking mechanisms;

determining if the elevator car is within a predetermined proximity of each of the access openings with the plurality of locking mechanisms by detecting an unlocking element disposed on the elevator car with the plurality of locking mechanisms, wherein the predetermined proximity comprises alignment of an elevator car door and the landing door, each of the plurality of locking mechanisms being a proximity sensor that does not require direct engagement with the unlocking element to switch between the locked condition and the unlocked condition; and unlocking the landing door if the elevator car is determined to be within the predetermined proximity of the access opening.

6. The method of claim 5, wherein unlocking the landing door comprises maintaining all of the other landing doors in the locked condition.

* * * * *